US010449411B2

(12) United States Patent
Cei et al.

(10) Patent No.: US 10,449,411 B2
(45) Date of Patent: Oct. 22, 2019

(54) MANUAL TREADMILL

(71) Applicant: TECHNOGYM S.P.A., Forli'-Cesena (IT)

(72) Inventors: Daniele Cei, Forli'-Cesena (IT); Luca Benini, Ravenna (IT); Marco Piacenti, Forli'-Cesena (IT)

(73) Assignee: TECHNOGYM S.P.A., Forli'-Cesena (IT)

( * ) Notice: Subject to any disclaimer, the term of this patent is extended or adjusted under 35 U.S.C. 154(b) by 21 days.

(21) Appl. No.: 14/966,496

(22) Filed: Dec. 11, 2015

(65) Prior Publication Data

US 2016/0166877 A1 Jun. 16, 2016

(30) Foreign Application Priority Data

Dec. 12, 2014 (IT) ..... MI2014A2131

(51) Int. Cl.
*A63B 22/02* (2006.01)

(52) U.S. Cl.
CPC ..... *A63B 22/02* (2013.01); *A63B 22/0285* (2013.01); *A63B 2225/30* (2013.01)

(58) Field of Classification Search
CPC . A63B 22/02; A63B 22/0207; A63B 22/0271; A63B 22/0278; A63B 22/0285; A63B 22/0292; A63B 21/00058; A63B 21/00069; A63B 21/00076; A63B 21/00185; A63B 21/012; A63B 21/0125; A63B 21/015; A63B 21/018; A63B 21/068; A63B 21/15; A63B 21/151; A63B 21/154; A63B 21/22; A63B 21/225; A63B 21/4027; A63B 21/4033; A63B 21/4034; A63B 21/4045; A63B 21/4049; A63B 22/0015; A63B 22/0017; A63B 22/0025; A63B 22/0046; A63B 22/0214;
(Continued)

(56) References Cited

U.S. PATENT DOCUMENTS 27,278 A * 2/1860 Dodge ..... A63B 22/0023 185/16
1,211,765 A * 1/1917 Schmidt ..... A63B 22/02 482/54

(Continued)

FOREIGN PATENT DOCUMENTS

CN 202020840 U 1/2011
CN 202909373 U 5/2013
WO 9936129 A1 7/1999

*Primary Examiner* — Gary D Urbiel Goldner
(74) *Attorney, Agent, or Firm* — Arent Fox LLP; Michael Fainberg

(57) ABSTRACT

A manual treadmill for exercise of a user is disclosed. In one aspect, the manual treadmill comprises: a frame extending along a longitudinal direction and rotational shafts configured to rotate about corresponding rotational axes transverse to the longitudinal direction of the frame; and an exercise belt operatively connected to the rotational shafts, so as to form an endless closed exercise path having an upper portion configured to interact with the user and a lower portion facing a reference plane. The upper portion has a set curved side profile along the longitudinal direction of the frame so that a force generated by the user on the exercise belt produces rotation of the rotational shafts and the exercise belt.

25 Claims, 8 Drawing Sheets

(58) Field of Classification Search
CPC . A63B 22/0221; A63B 22/0228; A63B 22/18; A63B 22/20; A63B 22/201; A63B 22/208; A63B 2022/0038; A63B 2022/206; A63B 23/035; A63B 23/03516; A63B 23/04; A63B 23/0405; A63B 23/047; A63B 23/0482; A63B 23/0494; A63B 69/0022; A63B 69/0024; A63B 69/0026; A63B 69/0028; A63B 69/0035; A63B 69/18; A63B 69/182; A63B 2069/0031; A63B 71/0054; A63B 2071/0063; A63B 2071/0072; A63B 2071/0081; A63B 2071/009; A63B 2208/0204
See application file for complete search history.

(56) References Cited

U.S. PATENT DOCUMENTS 2,842,365 A * 7/1958 Kelley ..... A63B 69/0035 482/51
3,642,279 A * 2/1972 Cutter ..... A63B 22/02 482/54
4,334,676 A * 6/1982 Schonenberger ..... A63B 22/02 482/54
4,389,047 A * 6/1983 Hall ..... A63B 21/0054 482/2
4,614,337 A * 9/1986 Schonenberger ..... A63B 22/02 482/54
5,385,520 A * 1/1995 Lepine ..... A63B 22/0023 482/51
5,470,293 A * 11/1995 Schonenberger ..... A63B 22/02 198/834
5,571,254 A * 11/1996 Saeki ..... B66B 21/12 198/324
5,577,598 A * 11/1996 Schoenenberger ..... A63B 22/0285 198/832.2
5,709,632 A * 1/1998 Socwell ..... A63B 22/0012 482/51
5,833,584 A * 11/1998 Piaget ..... A63B 22/0012 482/70
5,897,461 A * 4/1999 Socwell ..... A63B 22/0012 482/54
6,053,848 A * 4/2000 Eschenbach ..... A63B 22/02 482/51
6,095,952 A * 8/2000 Ali ..... A63B 22/02 482/35
6,348,025 B1 * 2/2002 Schonenberger ..... A63B 22/02 198/334
8,308,619 B1 * 11/2012 Astilean ..... A63B 21/156 482/54
8,690,738 B1 4/2014 Astilean
8,864,627 B2 * 10/2014 Bayerlein ..... A63B 21/0053 482/2
8,986,169 B2 * 3/2015 Bayerlein ..... A63B 21/0053 482/54
9,114,276 B2 * 8/2015 Bayerlein ..... A63B 21/0053
9,216,316 B2 * 12/2015 Bayerlein ..... A63B 21/0053
2008/0096745 A1 * 4/2008 Perry ..... A63B 22/00 482/148
2012/0010048 A1 * 1/2012 Bayerlein ..... A63B 21/0053 482/2
2012/0010053 A1 * 1/2012 Bayerlein ..... A63B 21/0053 482/54
2012/0157267 A1 * 6/2012 Lo ..... A63B 22/02 482/54
2012/0231934 A1 * 9/2012 Lo ..... A63B 22/02 482/54
2012/0270705 A1 * 10/2012 Lo ..... A63B 22/02 482/54
2014/0011642 A1 * 1/2014 Astilean ..... A63B 22/02 482/54
2014/0080679 A1 * 3/2014 Bayerlein ..... A63B 21/0053 482/54
2014/0213419 A1 * 7/2014 Bayerlein ..... A63B 21/0053 482/54
2015/0038297 A1 * 2/2015 Bayerlein ..... A63B 21/0053 482/2

* cited by examiner

MANUAL TREADMILL

CROSS-REFERENCE TO RELATED APPLICATIONS

This application claims benefit of priority under 35 U.S.C. 119(a)-(d) to Italian Application No. MI2014A002131 filed Dec. 12, 2014, which is incorporated by reference herein.

FIELD OF THE INVENTION

The present invention generally relates to the field of manual treadmills, and in particular to a curved manual treadmill.

BACKGROUND

As known, an either straight or curved "manual" treadmill is a motorless exercise machine which can be manually actuated by the user through the interaction of the lower limbs with the walking/running belt. In other words, a "manual" treadmill does not have a motor.

A straight or curved manual treadmill typically comprises a frame extending along a longitudinal development direction parallel to the user's advancement direction while walking or running.

Moreover, such a manual treadmill comprises a first front rotational shaft and a second rear rotational shaft about which a walking/running belt is wound.

In the case of a curved manual treadmill, the user's walking/running belt is typically mounted on the first front rotational shaft and on the second rear rotational shaft so as to have a curved side profile along, and with respect to, the longitudinal development direction of the frame on the part facing upwards, i.e. having a first descending portion starting from the first front rotational shaft and a second portion, opposite to the first portion, ascending towards the second rear rotational shaft.

While the user runs or walks on the walking/running belt, the weight force exerted by the user at the first descending portion of the walking/running belt allows the potential energy to be transformed into kinetic energy and thus the rotation of the walking/running belt from the first front rotational shaft to the second rear rotational shaft to be generated only by means of the interaction of the user's lower limbs with the walking/running belt.

In order to ensure the rotation of the walking/running belt only by means of the interaction of the user's lower limbs, it is desirable to have a walking/running belt which keeps the curved side profile as much as possible with respect to the longitudinal development of the base.

Several technical solutions exist today to address this issue.

In a first technical solution of the prior art, the frame of the manual treadmill is provided with corresponding side guides closed along the entire curved side profile of the walking/running belt. The walking/running belt is provided on both sides with corresponding bearings inserted and suitable to roll within the side guides of the manual treadmill frame.

Such a solution has drawbacks related to the excessive friction of the bearings when they roll within the side guides, resulting in a greater sliding resistance with a consequential reduction in the manual treadmill's efficiency and an increase of its noise. Furthermore, there is a problem of tolerances between each side guide and the walking/running belt, which must have some clearance. Again, such a solution has assembly drawbacks including the difficulty of keeping the correct center to center distances between the center of the curved side profile of each side guide, the first front rotational shaft and the second rear rotational shaft.

In another technical solution of the prior art, instead, the manual treadmill is provided with a so-called synchronization belt between the first front rotational shaft and the second rear rotational shaft, suitable to ensure the synchronized rotation of the first front rotational shaft and of the second rear rotational shaft during the rotation of the walking/running belt.

However, this solution also has the disadvantage related to the friction generated by the rolling of a belt.

Furthermore, this solution suffers from increased noise due to the meshing of the teeth, specifically if the synchronization belt is toothed. Furthermore, when a braking action is applied, the elasticity of the synchronization belt causes a tensioning of the walking/running belt on the side facing upwards.

This causes the walking/running belt to lift from the side support rollers, resulting in the knocking of the walking/running belt on the side support rollers at the user's each step.

SUMMARY OF THE INVENTION

It is the object of the present invention to construe and make available a manual treadmill, especially curved, improved with respect to those of the prior art, allowing it to maintain a curved side profile as much as possible, at least partially avoiding the drawbacks of prior art designs indicated hereinabove, thus ensuring greater reliability in terms of friction, efficiency, noise and ease of assembly.

Such an object is achieved by a manual treadmill comprising: a frame extending along a longitudinal direction; a first rotational shaft suitable to rotate about a corresponding first rotational axis transverse to the longitudinal direction of the frame; a second rotational shaft suitable to rotate about a corresponding second rotational axis transverse to the longitudinal direction of the frame; an exercise belt operatively connected to the first rotational shaft and the second rotational shaft, so as to form an endless closed exercise path, the exercise path comprising an upper portion suitable to interact with the user, and a lower portion facing a reference plane on which the manual treadmill lies, the upper portion having a set curved side profile along the longitudinal direction of the frame, so that a force generated by the user on the exercise belt generates the rotation of the first rotational shaft and the second rotational shaft causing the displacement of the exercise belt from the first rotational shaft to the second rotational shaft, wherein: the exercise belt comprises a first outer surface suitable to interact with the user, when said first outer surface corresponds to the upper portion of the exercise path, and a second inner surface, opposite the first outer surface, the exercise belt comprising a sliding element of the exercise belt with respect to the frame coupled to the second inner surface, the frame comprises a constraint element of the exercise belt to the frame, which is suitable to cooperate with the sliding element, when the second inner surface of the exercise belt corresponds to the upper portion of the exercise path formed by the exercise belt, along at least one part of the upper portion of the exercise path formed by the exercise belt, the constraint element being shaped so as to keep the curved side profile of the upper portion of the exercise path formed by the exercise belt substantially equal to the determined curved side profile.

The above simplified summary of example embodiments of the invention serves to provide a basic understanding of the invention. This summary is not an extensive overview of all contemplated aspects, and is intended to neither identify key or critical elements of all invention nor delineate the scope of any or all embodiments of the invention. Its sole purpose is to present one or more embodiments in a simplified form as a prelude to the more detailed description of the invention that follows. To the accomplishment of the foregoing, the one or more embodiments of the invention include the features described and particularly pointed out in the claims.

BRIEF DESCRIPTION OF THE DRAWINGS

Further features and advantages of the manual treadmill according to the invention will become apparent in the following description which shows preferred embodiments, given by way of indicative, non-limiting examples, with reference to the accompanying drawings, in which.

DETAILED DESCRIPTION OF EXEMPLARY EMBODIMENTS

Figure 1:
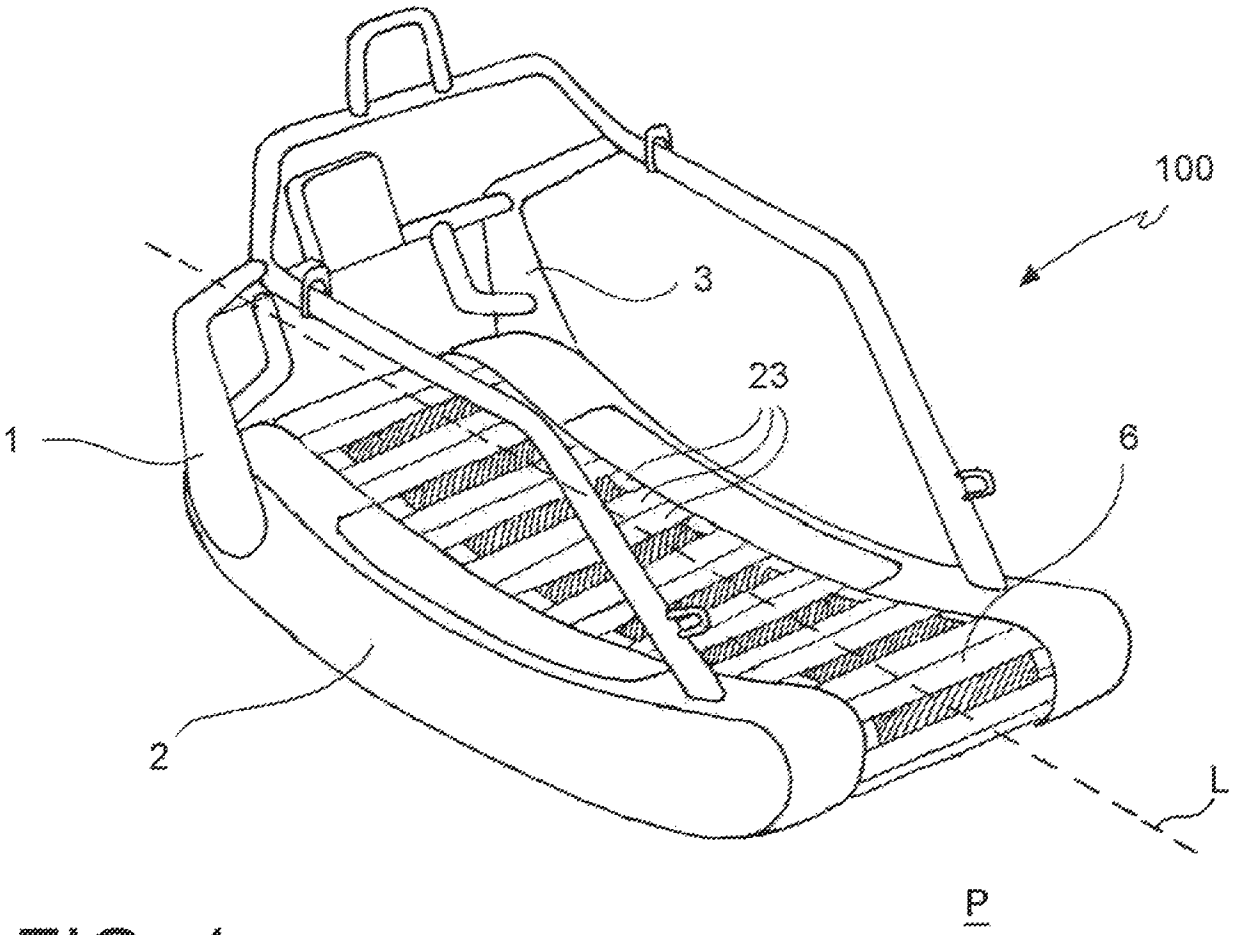
FIG. 1 diagrammatically shows a perspective view of a manual treadmill.
Figure 2:
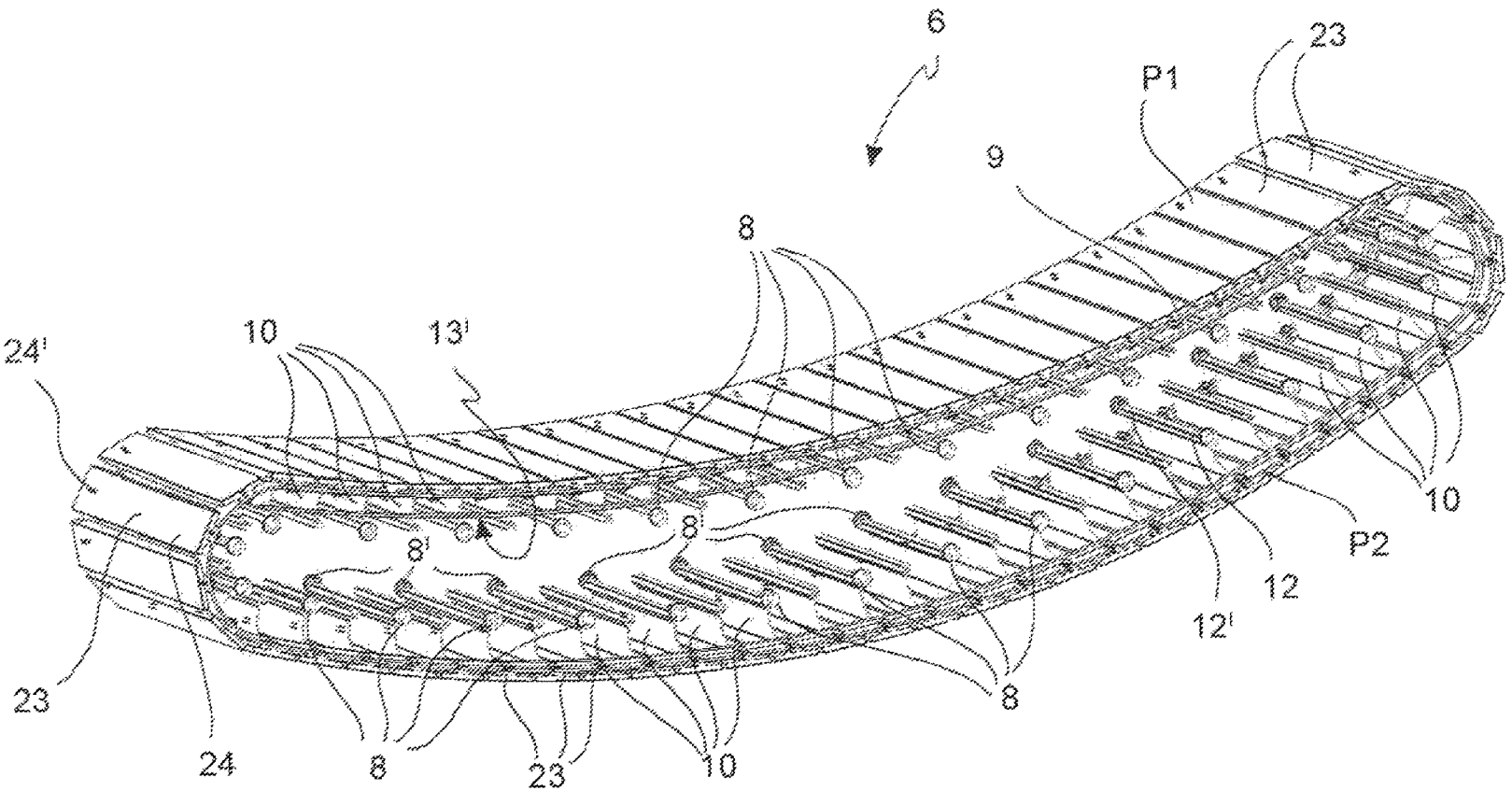
FIG. 2 diagrammatically shows a perspective view of a portion of the manual treadmill according to an embodiment of the invention.

Example embodiments of the present invention are described herein in the context of manual treadmill. Those of ordinary skill in the art will realize that the following description is illustrative only and is not intended to be in any way limiting. Other embodiments will readily suggest themselves to those skilled in the art having the benefit of this disclosure. Reference will now be made in detail to implementations of the example embodiments as illustrated in the accompanying drawings. The same reference indicators will be used to the extent possible throughout the drawings and the following description to refer to the same or like items.

In the figures, reference numeral 100 indicates as a whole a manual treadmill, hereinafter also simply treadmill, for the exercise of a user, according to the invention.

As previously mentioned, it is worth reasserting that a "manual" treadmill is a motorless exercise machine which can be manually actuated by the user by means of the interaction of the lower limbs with the exercise belt, which will be introduced hereinafter, while exercising.

In other words, a "manual" treadmill is a treadmill which does not have a motor.

Although reference will be generally made hereinafter to the manual treadmill as defined above, it will be apparent from the following description that the present invention especially relates to a curved manual treadmill.

Figure 3:
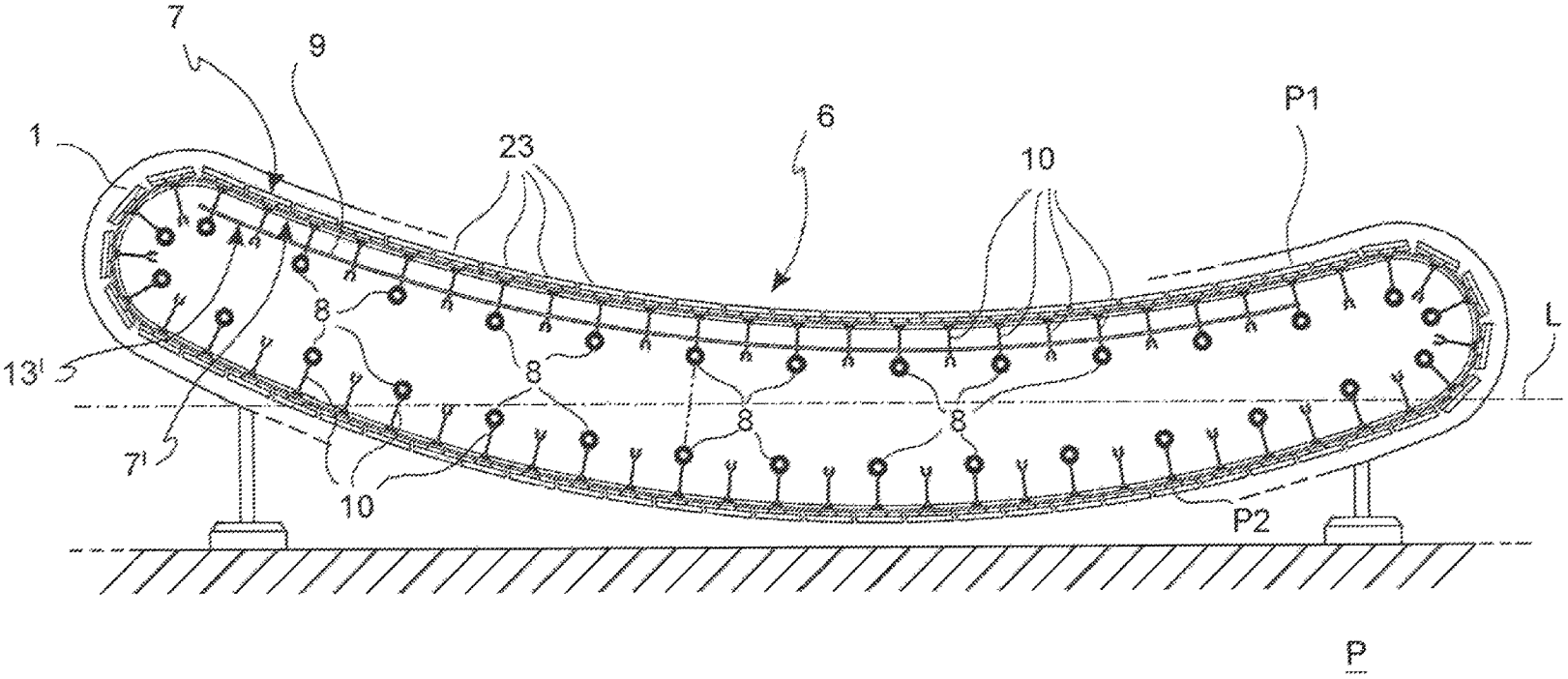
FIG. 3 diagrammatically shows a side section view of the portion of the manual treadmill shown in FIG. 2.
Figure 4:
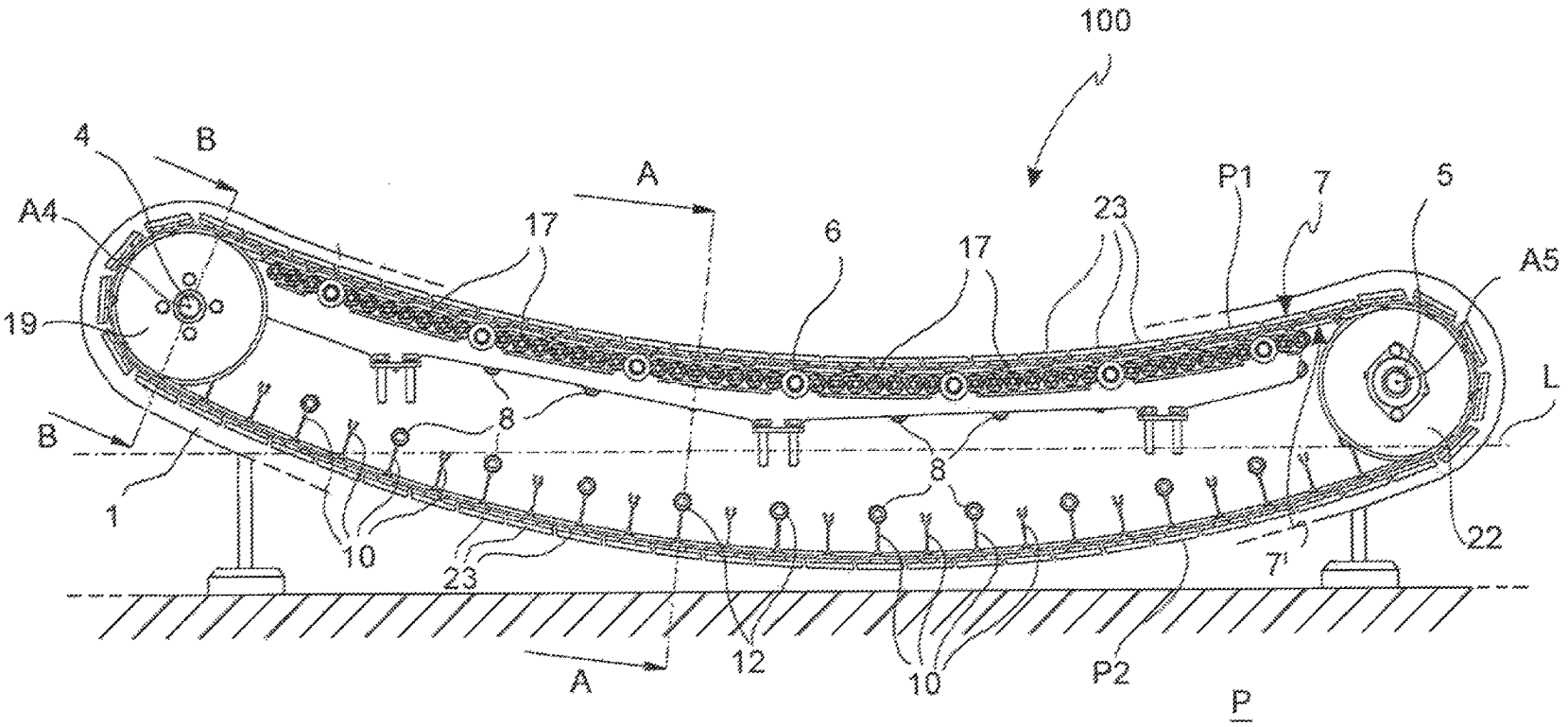
FIG. 4 diagrammatically shows a side view of a further portion of the manual treadmill according to an embodiment of the invention.

According to an embodiment, with particular reference to FIGS. 1, 3 and 4, the treadmill 100 comprises a frame 1 extending along a longitudinal direction L.

The longitudinal direction L is substantially parallel to a reference plane P representing the resting plane (e.g. a floor) of the treadmill 100.

With particular reference to FIG. 1, the frame 1 comprises a base portion 2 distributed parallel to the reference plane and a support portion 3 extending in a substantially vertical direction with respect to the reference plane P starting from the base portion.

In greater detail, for example, the support portion 3 is a combination of uprights and tubular members operatively connected to one another and distributed so as to define a support structure for the user when using the treadmill 100.

Now referring to FIG. 4, treadmill 100 further comprises a first rotational shaft 4 configured to rotate about a corresponding first rotational axis A4 transverse to the longitudinal direction L of the frame 1.

Furthermore, the frame 1 comprises a second rotational shaft 5 configured to rotate about a corresponding second rotational axis A5 transverse to the longitudinal direction L of the frame 1.

The second rotational axis A5 is parallel to the first rotational axis A4.

Now particularly referring to FIGS. 1, 2, 3 and 4, the frame 1 comprises an exercise belt 6 operatively connected to the first rotational shaft 4 and the second rotational shaft 5, so as to form an endless closed exercise path P1, P2.

The exercise path P1, P2 comprises an upper portion P1 suitable to interact with the user (not shown in the figure) and a lower portion P2 facing towards a reference plane P (e.g. the floor) on which the manual treadmill 100 lies.

As clearly visible in FIGS. 3 and 4, the upper portion P1 has a set curved side profile along the longitudinal direction L of the frame 1, so that a force generated by the user on the exercise belt 6 produces rotation of the first rotational shaft 4 and of the second rotational shaft 5 causing the displacement of the exercise belt 6 from the first rotational shaft 4 to the second rotational shaft 5.

For the purposes of the present description, it is worth noting that the exercise of a user means any exercise which can be performed by the user by placing the feet, or lower limbs in general, on the exercise belt, such as, for example, running, walking or any other physical cardiovascular training and/or muscular strengthening exercise which is allowed by a manual treadmill having an endless closed exercise path with a set curved side profile along the longitudinal direction L of the frame 1.

Figure 5:
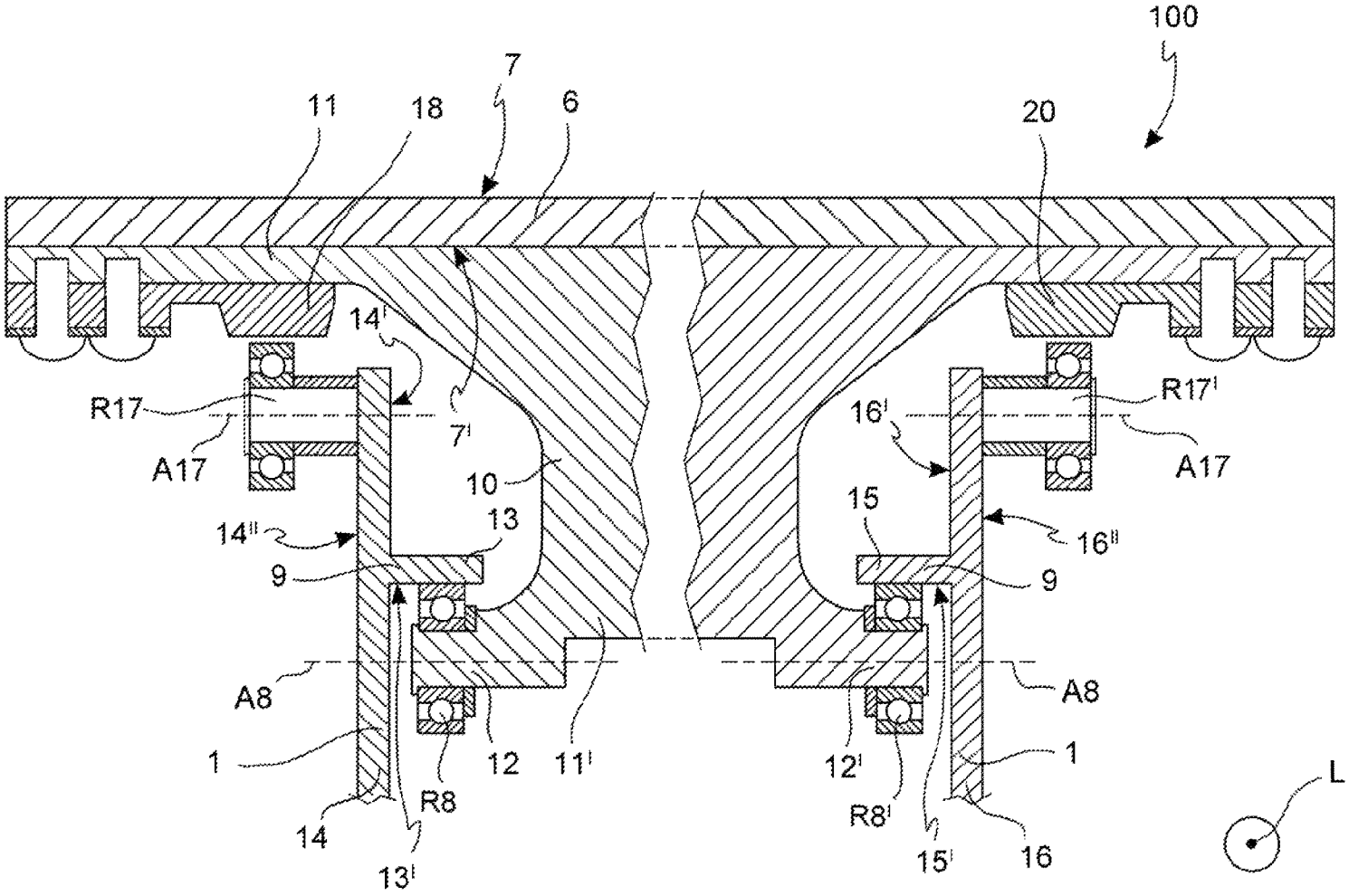
FIG. 5 diagrammatically shows a section view taken along plane AA in FIG. 4 of a portion of the manual treadmill according to the embodiment in FIG. 4.
Figure 6:
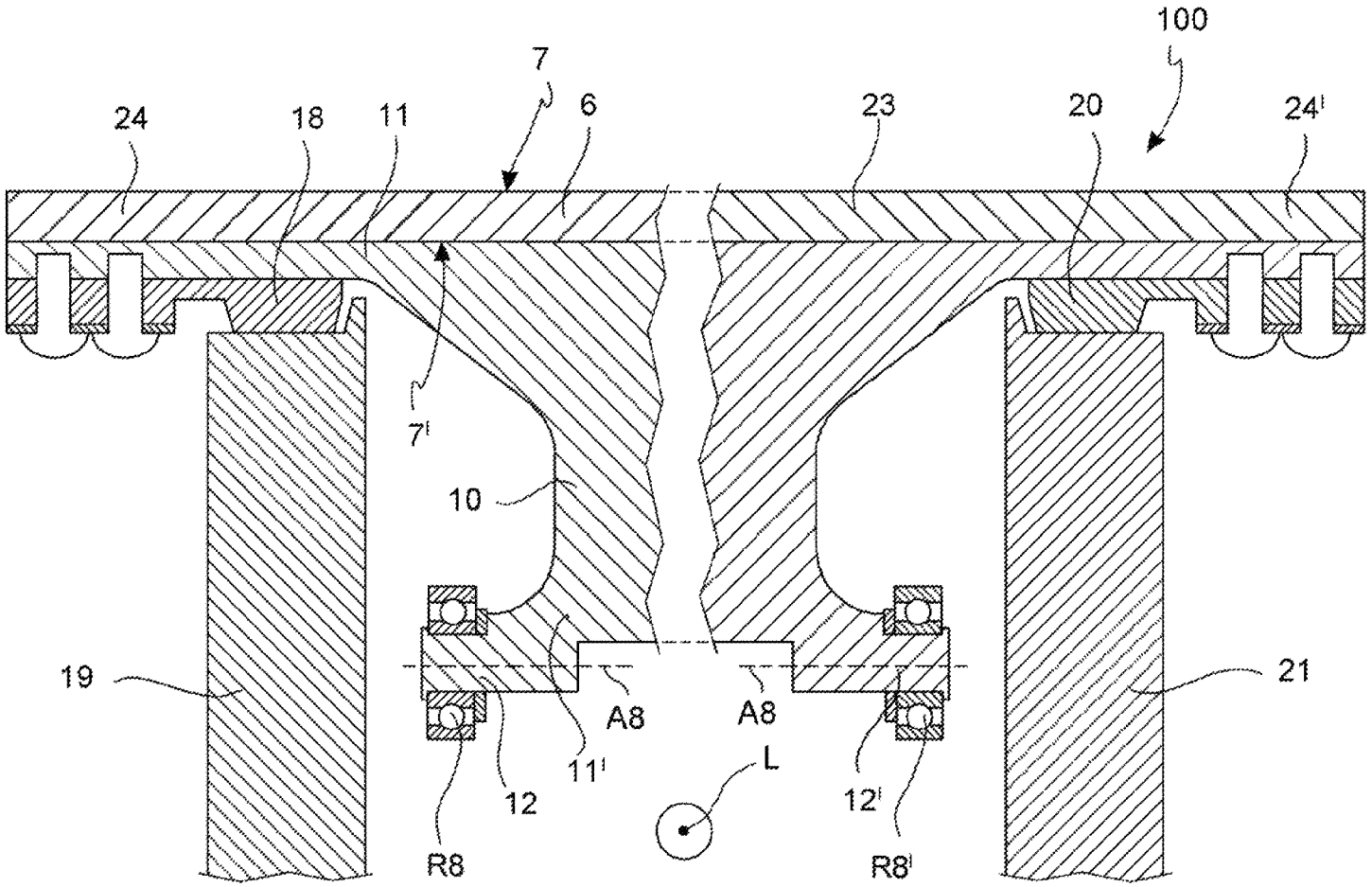
FIG. 6 diagrammatically shows a section view taken along plane BB in FIG. 4 of a further portion of the manual treadmill according to the embodiment in FIG. 4.

Now also referring to FIGS. 5 and 6, the exercise belt 6 comprises a first outer surface 7, facing towards the part opposite to the reference plane P, suitable to interact with the user, when the first outer surface 7 corresponds to the upper portion P1 of the exercise path P1, P2.

Furthermore, the exercise belt 6 comprises a second inner surface 7' opposite to the first outer surface 7. The second inner surface 7' faces towards the reference plane P when the first outer surface 7 corresponds to the upper portion P1 of the exercise path P1, P2.

Advantageously, the exercise belt 6 further comprises sliding elements 8, 8' for enabling sliding of the exercise belt 6 with respect to the frame 1, wherein the sliding elements 8, 8' are coupled to the second inner surface 7' of the exercise belt 6.

The sliding elements 8, 8' according to an embodiment of the present invention will be described below.

Furthermore, the frame 1 comprises a constraint element 9 for constraining the exercise belt 6 to the frame 1, wherein the constraint 9 is configured to be coupled to the exercise belt 6. The constraint 9 is further configured to cooperate with the sliding elements 8, 8', when the second inner surface 7' of the exercise belt 6 corresponds to the upper portion P1 of the exercise path P1, P2 formed by the exercise belt 6, along at least one part of the upper portion P1 of the exercise path P1, P2 formed by the exercise belt 6.

Advantageously, the constraint element 9 is shaped so as to keep the curved side profile of the upper portion P1 of the exercise path P1, P2 formed by the exercise belt 6 substantially equal to the set curved side profile P1 of the exercise path P1, P2.

In other words, the cooperation between the constraint element 9 and the sliding elements 8, 8' is configured to prevent the displacement of the upper portion P1 of the exercise path P1, P2 in a direction substantially orthogonal to a plane tangent, point-by-point, to the set curved side profile of the upper portion P1 of the exercise path P1, P2, consequently preventing the upper portion P1 of the exercise path P1, P2 from taking a side profile different from the set curved side profile.

The constraint element 9 will also be described in greater detail hereinafter with reference to a particular embodiment.

Now, according to an embodiment (as shown in the figures), the sliding elements 8, 8' comprise a first plurality of rotatable members R8, R8', each coupled to the exercise belt 6 in a freely rotatable manner about a corresponding rotational axis A8 transverse to the longitudinal direction L of the frame 1 (see FIGS. 5 and 6 in particular)—thereby allowing the sliding elements 8, 8' to rotate about the rotational axis A8.

In greater detail, each rotatable member R8, R8' of the first plurality of rotatable members R8, R8' is a roller or bearing.

According to an embodiment, as shown in the figures, the exercise belt 6 comprises a plurality of walls 10 extending from the second inner surface 7' of the exercise belt 6.

In greater detail, each wall 10 of the plurality of walls 10 has a proximal portion 11 coupled to the second inner surface 7' of the exercise belt 6 and a distal portion 11', opposite to the proximal portion 11, having a first side end 12 and a second side end 12', opposite to the first side end 12.

In an embodiment, shown in the figures, the first plurality of rotatable members R8, R8' is distributed on at least one part of said plurality of walls 10 so that a first rotatable member R8 and a second rotatable member R8' are coupled in a freely rotatable manner, respectively, to the first side end 12 and to the second side end 12' of a corresponding wall of said at least one part of said plurality of walls 10.

It is worth noting that in the embodiment shown in the figures, the first plurality of rotatable members R8, R8' is distributed alternatively on one wall and not on the other.

In a further embodiment, not shown in the figures, the first plurality of rotatable members R8, R8' is distributed on all the walls of the plurality of walls 10 so that a first rotatable member R8 and a second rotatable member R8' are coupled in a freely rotatable manner, respectively, to the first side end 12 and to the second side end 12' of each wall of the plurality of walls 10.

Turning back to the embodiment shown in the figures, the constraint element 9 of the exercise belt 6 to the frame 1 comprises at least one guide member 13 which is secured to the frame 1 comprising an abutment surface 13' for the first plurality of rotatable members R8, R8' of the sliding element 8.

The abutment surface 13' has a configuration such as to keep the curved side profile of the upper portion P1 of the exercise path P1, P2 formed by the exercise belt 6 substantially equal (in length) to the set curved side profile.

According to the embodiment shown in the figures, the first rotatable member R8 of said first rotatable member R8 and second rotatable member R8', coupled in a freely rotatable manner, respectively, to the first side end 12 and to the second side end 12' of a corresponding wall of at least one part of said plurality of walls 10, is advantageously configured to abut against the abutment surface 13'.

With particular reference to the embodiment in FIG. 5, the constraint element 9 of the exercise belt 6 to the frame 1 comprises at least one constraint wall 14, extending vertically with respect to the reference plane P, having a first inner surface 14' facing towards the distal end 11' of each wall 10 of the plurality of walls 10 and a second outer surface 14" opposite to the first inner surface 14'. At least one guide member 13 (e.g. a rib) extends starting from the first inner surface 14' so that the abutment surface 13' faces towards the reference plane P taking a profile corresponding to the set curved side profile.

Turning back to the embodiment shown in the figures in general, it is worth noting that the constraint element 9 of the exercise belt 6 to the frame 1 comprises a further guide member 15 secured to the frame 1 comprising a second abutment surface 15' for the first plurality of rotatable members R8, R8' of the sliding elements 8, 8'.

The second abutment surface 15' has a configuration such as to keep the curved side profile of the upper portion P1 of the endless closed exercise path P1, P2 formed by the exercise belt 6 substantially equal to the set curved side profile.

According to the embodiment shown in the figures, the second rotatable member R8 of said first rotatable member R8 and second rotatable member R8' coupled in a freely rotatable manner, respectively, to the first side end 12 and the second side end 12' of a corresponding wall of said plurality of walls 10, is configured to abut against the second abutment surface 15' (FIG. 5).

With particular reference to the embodiment shown in FIG. 5, the constraint element 9 of the exercise belt 6 to the frame 1 comprise at least one further constraint wall 16 extending vertically with respect to the reference plane P, having a first inner surface 16' facing towards the distal end 11' of each wall 10 of the plurality of walls 10 and a second outer surface 16", opposite to the first inner surface 16'. The further guide member 15 (e.g. a rib) extends starting from the first inner surface 16' so that the abutment surface 15' faces towards the reference plane P taking a profile corresponding to the set curved side profile.

Turning to the treadmill 100 in general, in combination with any one of the embodiments described above, the treadmill 100 further comprises support elements 17, 17' of the exercise belt 6.

The support elements 17, 17' comprise a second plurality of rotatable members R17, R17' each coupled to the frame 1 so as to be freely rotatable about a corresponding rotational axis A17, transverse to the longitudinal direction L of the frame 1—thereby allowing the support elements 17, 17' to rotate about the rotational axis A17.

The second plurality of rotatable members R17, R17' is arranged along the longitudinal direction L of the frame 1 according to a trajectory corresponding to the set curved side profile.

In such an arrangement, the plurality of rotatable members R17, R17' is configured to prevent the displacement of the upper portion P1 of the exercise path P1, P2 along a direction substantially orthogonal to a plane tangent, point-by-point, to the set curved side profile of the upper portion P1 of the exercise path P1, P2, consequently preventing the upper portion P1 of the exercise path P1, P2 from taking a side profile different from the set curved side profile.

It is worth noting that each rotatable members R17, R17' of the second plurality of rotatable members R17, R17' is a roller or bearing.

In greater detail, again with reference to the embodiment shown in the figures, the proximal portion 11 of each wall of said plurality of walls 10 extending starting from the second inner surface 7' of the exercise belt 6 is configured to abut against the second plurality of rotatable members R17, R17' of the support elements (17, 17'), coupled to the frame 1, of the exercise belt 6 to the frame 1.

In particular, according to a further embodiment, the proximal portion 11 of each wall of said plurality of walls 10 extending starting from the second inner surface 7' of the exercise belt 6 comprises a first motion transmission flexible member 18 configured to abut against a first portion of member R17 of the second plurality of rotatable members R17, R17'.

Furthermore, as shown in FIG. 6, the first motion transmission flexible member 18, beyond the first portion 17 of the second plurality of rotational members R17, R17', distributed according to a trajectory corresponding to the set curved side profile, thus at the upper portion P1 of the exercise path P1, P2 formed by the exercise belt 6, is configured to abut against a corresponding first pulley 19, operatively coupled to the first rotational shaft 4, configured to rotate about the first rotational axis A4.

With reference again to FIG. 6, the proximal portion 11 of each wall of said plurality of walls 10 extending starting from the second inner surface 7' of the exercise belt 6 comprises a second motion transmission flexible member 20 configured to abut against a second portion of member R17' of the second plurality of rotatable members R17, R17'.

Furthermore, as shown again in FIG. 6, the second motion transmission flexible member 20, beyond the second portion of member R17' of the second plurality of rotatable members R17, R17', distributed according to a trajectory corresponding to the set curved side profile, thus at the upper portion P1 of the exercise path P1, P2 formed by the exercise belt 6, is configured to abut against a corresponding second pulley 21, operatively coupled to the first rotational shaft 4, configured to rotate about the second rotational axis A4.

The first pulley 19 and the second pulley 21 are configured to rotate simultaneously under the action of the first rotational shaft 4.

It is worth noting that the first motion transmission flexible member 18 and the second motion transmission flexible member 20 are, for example, transmission belts configured to define a corresponding closed path corresponding to the exercise path P1, P2 formed by the exercise belt 6.

It is worth noting that the first motion transmission flexible member 18 is wound about the first pulley 19 and a further pulley 22 (FIG. 4) coupled to the second rotational shaft A5 so as to transmit the rotation from the first rotational shaft A4 to the second rotational shaft A5 or vice versa.

Similarly, the second motion transmission flexible member 20 is wound about the second pulley 21 and a further pulley (not shown in the figures) coupled to the second rotational shaft A5 so as to transmit the rotation of the first rotational shaft A4 to the second rotational shaft A5, and vice versa.

Turning back to the embodiment shown in the figures in general, in combination with any one of the other embodiments described above, the exercise belt 6 comprises a plurality of slats 23 mutually placed side by side, each having a longitudinal extension direction which is transverse with respect to the longitudinal direction L of the frame 1.

In greater detail, each slat 23 of the plurality of slats 23 comprises a first end 24 and a second end 24', opposite to said first end 24.

As shown in FIG. 6, the first end 24 of each slat 23 is secured, e.g. by means of screws (shown in the figure), to the first motion transmission flexible member 18, operatively coupled to the first rotational shaft 4 and to the second rotational shaft 5 so as to define the endless closed exercise path P1, P2 of the exercise belt 6.

The second end 24' of each slat 23 is secured, e.g. by means of screws (shown in the figure), to the second motion transmission flexible member 20 operatively coupled to the first rotational shaft 4 and the second rotational shaft 5 so as to define the endless closed exercise path P1, P2 of the exercise belt 6.

According to the embodiment shown in figures, each wall 10 of said plurality of walls 10 is coupled to a corresponding slat 23 of said plurality of slats 23.

According to a further embodiment (not shown in the figures), the exercise belt 6 may be in one piece, e.g. made of flexible plastic material.

Figure 7:
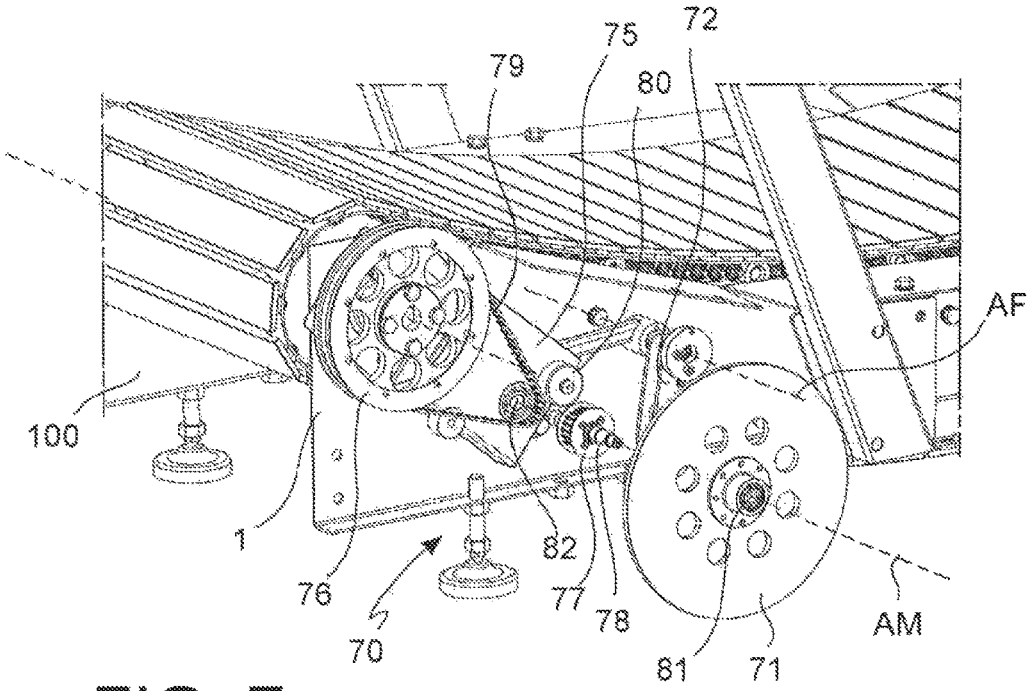
FIGS. 7 and 8 show exploded views of a braking device of a manual treadmill according to a further embodiment of the invention.
Figure 8:
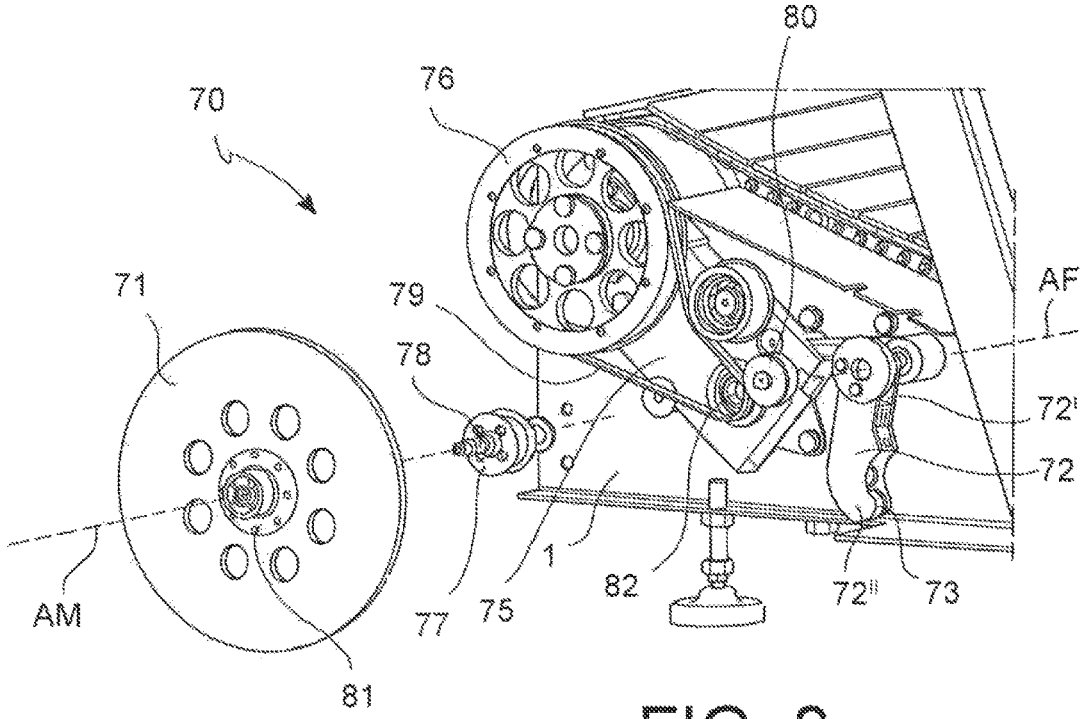
Figure 9:
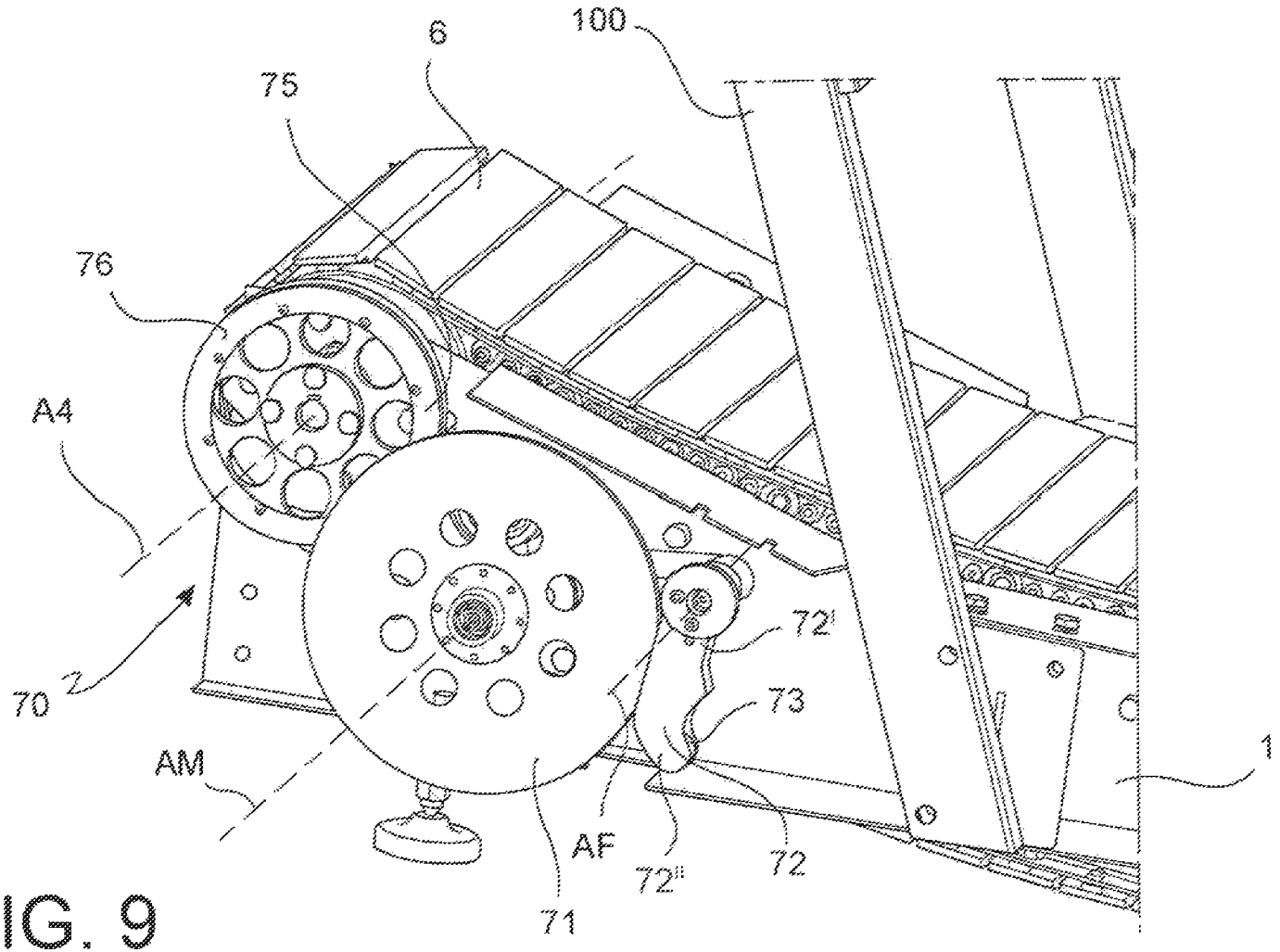
FIG. 9 shows a perspective view of the braking device in FIGS. 7 and 8 assembled on the manual treadmill.

Now, with particular reference to FIGS. 7, 8 and 9, according to a further embodiment, in combination with or alternatively to any one of the embodiments described above, the manual treadmill 100 further comprises a braking device 70 operatively coupled to the first rotational shaft 4 (not shown in FIGS. 7 and 8).

In an alternative embodiment (not shown in the figures), the braking device 70 could be operationally coupled to the second rotational shaft 5.

Turning back to the embodiment shown in FIGS. 7, 8 and 9, the braking device 70 comprises at least one metal disc 71 (e.g. made of copper or aluminum), configured to rotate about a corresponding rotational axis AM, which is parallel to the rotational axis A4 of the first rotational shaft 4.

Furthermore, the braking device 70 comprises an actuation bracket 72 (only partially visible in FIG. 7) having at least one magnet 73.

The actuation bracket 72 is shaped to exert on the metal disc 71 a braking action due to the magnetic effect following the interaction of said at least one magnet 73 with the metal disc 71.

More in detail, the actuation bracket 72 comprises a first end 72' operatively coupled to the frame 1 and a second end 72", which is free, opposite to the first end 72'.

In particular, the first end 72' is configured to rotate freely about a respective rotational axis AF.

Said at least one magnet 73 is operatively coupled to the second end 72".

It is worth noting that the actuation bracket 72 can be actuated by the user by means of a control or lever (not shown in the figures) preferably coupled to the upper support portion 3 of the frame 1, easily accessible by the user also while exercising.

It is worth noting that the actuation of the control or lever by the user is configured to cause the rotation of the actuation lever 72 about the rotational axis AF of the first end 72', the displacement of the second end 72", and thus the displacement of at least one magnet 73, with respect to the metal disc 71. Naturally, the braking action determined by the user will vary according to the position taken by said at least one magnet 73 with respect to the metal disc 71, i.e. to the level of overlap of said at least one magnet 73 with respect to the metal disc 71. It is worth noting that the braking action will be zero if there is no overlap between said at least one magnet 73 and the metal disc 71.

Turning back to the braking device 70 in FIGS. 7, 8 and 9, it is worth noting that the metal disc 71 and the actuation bracket 72 are operatively connected to the frame 1.

Furthermore, the metal disc 71 is operatively connected to the first rotational shaft 4 by means of a belt-pulley mechanism 75 with which the treadmill 100 is provided.

In greater detail, the belt-pulley mechanism 75 comprises a first pulley 76 and a second pulley 77.

The first pulley 76 is integral with the first rotational shaft 4.

The second pulley 77 is coupled to the frame 1 so as to be freely rotational about the rotational axis AM of the magnetic disc 71.

In greater detail, the second pulley 77 is integral with a corresponding third rotational axis 78 configured to rotate about the rotational axis AM of the magnetic disc 71.

Indeed, the metal disc 71 is operatively coupled to the third rotational shaft 78 so as to rotate about the corresponding rotational axis AM.

The belt-pulley mechanism 75 further comprises a motion transmission belt 79 operatively connected to the first pulley 76 and to the second pulley 77.

The belt-pulley mechanism 75 further comprises an auxiliary wheel 80, configured to rotate freely about a corresponding rotational axis operatively coupled to the frame 1, so that the motion transmission belt 79 is constrained between the second pulley 77 and the auxiliary wheel 80.

This particular configuration allows the motion transmission belt 79 to keep the correct position during motion transmission avoiding the use of additional tensioning members of the motion transmission belt 79, thus obtaining a reduction of the friction and an increase of efficiency of the braking device 70.

Turning back to the treadmill 100 in general, but with reference again to FIGS. 7, 8 and 9, the treadmill 100, according to an embodiment, comprises a first coupling device 81 by means of which the metal disc 71 of the braking device is operatively coupled to the third rotational shaft 78.

The first coupling device 81 is, for example, a free wheel type mechanism.

The first coupling device 81, if the rotation speed of the first rotational shaft 4 is lower than the rotation speed of the metal disc 71, is configured to prevent the transmission of the inertia of the magnetic disc 71 to the exercise belt 6, thus preventing drawbacks for the user.

Furthermore, the treadmill 100 comprises a second coupling device 82 operatively coupled to the second pulley 77.

The second coupling device 82 is, for example, a free wheel type mechanism.

It is worth noting that the coupling device 82 is configured to allow the rotation of the upper portion P1 of the exercise path P1, P2 formed by the exercise belt 6 from the first rotational shaft 4 to the second rotational shaft 5 and configured to prevent the rotation of the upper portion P1 itself of the exercise path P1, P2 formed by the exercise belt 6 in opposite sense, i.e. from the second rotational shaft 5 to the first rotational shaft 4. In other words, the second coupling device 82 allows the exercise belt 6 to be one-way.

It is worth noting that the braking device 70 described above with particular reference to its application on the manual treadmill 100 according to the present invention could be applied to any other manual treadmill, either straight or curved.

An example of operation of the manual treadmill 100 will now be described with reference to the aforesaid figures.

The user climbs onto the exercise belt 6 to perform exercises on the exercise belt 6, which is configured to rotate about the first rotational shaft 4 and the second rotational shaft 5.

During an exercise, the constraint element 9 of the exercise belt 6 to the frame 1 cooperate with the sliding element 8, when the second inner surface 7' of the exercise belt 6 corresponds to the upper portion P1 of the exercise path P1, P2 formed by the exercise belt 6, along at least part of the upper portion P1 of the exercise path P1, P2 formed by the exercise belt 6.

The configuration of the constraint element 9 (the abutment surface 13' and a further abutment surface 15'), described above, advantageously allows the curved side profile of the upper portion P1 of the exercise path P1, P2 formed by the exercise belt 6 to be kept substantially equal to the set curved side profile.

If needed, the user may operate the braking device 70 to increase the resistance of the exercise belt 6 or to stabilize and even out the accelerations to which the exercise belt 6 is subjected, in order to perform, for example, thrust exercises on the exercise belt 6, by placing the upper limbs in the corresponding supports or handles of the frame 1.

As apparent, the object of the invention is fully achieved because the above-described manual treadmill has many advantages, as previously mentioned.

Firstly, the manual treadmill is certainly an alternative to the ones described with reference to the background art.

Indeed, the configuration of the constraint element 9 of the exercise belt 6 to the frame 1 allows the curved side profile of the upper portion P1 of the exercise belt P1, P2 formed by the physical exercise belt 6 to be kept substantially equal to the set curved side profile.

Furthermore, the fact that the constraint element 9 of the exercise belt 6 to the frame 1 simply defines an abutment surface for the sliding elements 8, 8' advantageously allows the manual treadmill to be assembled in a simpler manner.

Again, the fact that the cooperation of the constraint element 9 of the exercise belt 6 of the frame 1 with the sliding elements 8, 8' occurs only when the second inner surface 7' of the exercise belt 6 corresponds to the upper portion P1 of the exercise path P1, P2, greatly reduces the friction and the subsequent noise resulting from the contact between the sliding elements 8, 8' and the constraint element 9.

Finally, the presence of support elements 17, 17' of the exercise belt 6 comprising a second plurality of rotatable members R17, R17' distributed along the longitudinal direction L of the frame 1 according to a trajectory corresponding to the set curved side profile further allows the curved side profile of the first portion P1 of the exercise path P1, P2 to be kept substantially equal to the set curved side profile.

Furthermore, the fact that the curved side profile of the first portion P1 of the endless closed exercise path P1, P2 is maintained either both by means of a bottom-up abutment, orthogonal to the direction tangent, point-by-point, to the abutment surface and by means of a top-down abutment, orthogonal to the direction tangent, point-by-point, to the trajectory defined by the support elements 17, 17' of the exercise belt 6 allows the set curved side profile to be reliably ensured with a structure which is simple to be assembled in all cases.

This is due, for example, to the lack of closed path guides as in the described prior art.

Finally, the use of a first plurality of rotatable members R8, R8' and a second plurality of rotatable members R17, R17' configured to be engaged in abutment with the abutment surface and the first (and second) motion transmission flexible member, without the aid of gear coupling (e.g. toothed), allows again a rather silent configuration with high efficiency in terms of wear and maintenance.

The described and claimed exemplary embodiments of the manual treadmill are not limited to the described devices, elements and structures, but can include all equivalents thereof known to those of ordinary skill in the art. Those skilled in art may make changes and adaptations to the above-described embodiments or can replace elements with others which are functionally equivalent in order to meet contingent needs without departing from the scope of the following claims. All the features described as belonging to one possible embodiment may be implemented independently of the other embodiments described.

Furthermore, it is to be understood that the phraseology or terminology used herein is for the purpose of description and not of restriction, such that the terminology or phraseology of the present specification is to be interpreted by the skilled in the art in light of the teachings and guidance presented herein, in combination with the knowledge of the skilled in the relevant art(s). Moreover, it is not intended for any term in the specification or claims to be ascribed an uncommon or special meaning unless explicitly set forth as such.

The invention claimed is:

1. A curved manual treadmill for an exercise of a user, comprising:

a frame extending along a longitudinal direction;

a first rotational shaft configured to rotate about a corresponding first rotational axis transverse to the longitudinal direction of the frame;

a second rotational shaft configured to rotate about a corresponding second rotational axis transverse to the longitudinal direction of the frame; and an exercise belt operatively connected to the first rotational shaft and the second rotational shaft, so as to form an endless closed exercise track, the endless closed exercise track comprising an upper portion for being actuated by the user, a lower portion facing a reference plane on which the curved manual treadmill lies, and a width extending transversely with respect to the longitudinal direction of the frame between a first side edge of the upper portion and a second side edge of the upper portion, opposite the first side edge of the upper portion, the upper portion having a set curved side profile along the longitudinal direction of the frame, so that a force generated by the user on the exercise belt produces a rotation of the first rotational shaft and the second rotational shaft causing a displacement of the exercise belt from the first rotational shaft to the second rotational shaft, wherein:

the exercise belt comprises an outer surface corresponding to the upper portion of the endless closed exercise track, and an inner surface, opposite the outer surface, the exercise belt comprising a plurality of sliding elements coupled to the inner surface, the plurality of sliding elements enabling a sliding of the exercise belt with respect to the frame, the plurality of sliding elements extending starting from the inner surface of the exercise belt, and the frame comprises a plurality of constraint elements arranged within the upper portion, the lower portion, and the width of the endless closed exercise track that are configured to couple the exercise belt to the frame and further configured to engage with the plurality of sliding elements, the plurality of constraint elements constraining the exercise belt coupled to the frame, when the inner surface of the exercise belt corresponds to the upper portion of the endless closed exercise track formed by the exercise belt, along at least one part of the upper portion of the endless closed exercise track formed by the exercise belt, the plurality of constraint elements being shaped so as to maintain the set curved side profile of the upper portion of the endless closed exercise track formed by the exercise belt substantially equal in length to a curved side profile of the curved manual treadmill.

2. The curved manual treadmill according to claim 1, wherein the plurality of sliding elements comprise a first plurality of rotatable members, each of the first plurality of rotatable members being coupled to the exercise belt in a freely rotatable manner about a corresponding rotational axis transverse to the longitudinal direction of the frame.

3. The curved manual treadmill according to claim 2, wherein the exercise belt comprises a plurality of walls extending starting from the inner surface of the exercise belt, a first wall and a second wall of the plurality of walls having a first portion coupled to the inner surface of the exercise belt and a second portion, opposite the first portion, having a first side end and a second side end, opposite the first side end, wherein the first plurality of rotatable members are arranged on at least one part of said plurality of walls so that:

a first rotatable member of the first plurality of rotatable members is coupled in a freely rotatable manner to the first side end of the first wall on said at least one part of said plurality of walls, and a second rotatable member of the first plurality of rotatable members is coupled in a freely rotatable manner to the second side end of the second wall on said at least one part of said plurality of walls.

4. The curved manual treadmill according to claim 3, wherein a first of the plurality of constraint elements comprises a first guide member secured to the frame, the first guide member comprising a first abutment surface for the first plurality of rotatable members of the plurality of sliding elements, the first abutment surface having a configuration so as to maintain the set curved side profile of the upper portion of the endless closed exercise track formed by the exercise belt substantially equal in length to the curved side profile of the curved manual treadmill.

5. The curved manual treadmill according to claim 4, wherein the first rotatable member coupled in a freely rotatable manner to the first side of a corresponding wall of said at least one part of said plurality of walls is configured to abut against the abutment surface.

6. The curved manual treadmill according to claim 5, wherein a second of the plurality of constraint elements comprises a second guide member secured to the frame, the second guide member comprising a second abutment surface for the first plurality of rotatable members of the plurality of sliding elements, the second abutment surface having a configuration so as to maintain the set curved side profile of the upper portion of the endless closed exercise track formed by the exercise belt substantially equal in length to the curved side profile of the curved manual treadmill.

7. The curved manual treadmill according to claim 6, wherein the second rotatable member coupled in a freely rotatable manner to the second side end of a corresponding wall of said at least one part of said plurality of walls is configured to abut against the second abutment surface.

8. The curved manual treadmill according to claim 4, further comprising a braking device operatively coupled to the first rotational shaft, the braking device comprising at least one metal disc configured to rotate about a corresponding rotational axis that is parallel to the first rotational axis of the first rotational shaft, said braking device further comprising an actuation bracket comprising at least one magnet, the actuation bracket being configured to exert on the at least one metal disc a braking action due to a magnetic effect following the interaction of said at least one magnet with the at least one metal disc.

9. The curved manual treadmill according to claim 4, comprising a plurality of support elements of the exercise belt comprising a second plurality of rotatable members, each of the second plurality of rotatable members being coupled to the frame so as to be freely rotatable about a corresponding rotational axis transverse to the longitudinal direction of the frame, wherein the second plurality of rotatable members are distributed along the longitudinal direction of the frame according to a trajectory corresponding to the set curved side profile.

10. The curved manual treadmill according to claim 4, wherein the exercise belt comprises a plurality of slats placed side by side, each having a longitudinal extension direction that is transverse with respect to the longitudinal direction of the frame.

11. The curved manual treadmill according to claim 10, wherein the first and second walls of said plurality of walls are coupled to a corresponding slat of said plurality of slats.

12. The curved manual treadmill according to claim 3, comprising a plurality of support elements of the exercise belt comprising a second plurality of rotatable members for respectively enabling a rotation of the plurality of support elements, each of the second plurality of rotatable members being coupled to the frame so as to be freely rotatable about a corresponding rotational axis transverse to the longitudinal direction of the frame, wherein the second plurality of rotatable members are distributed along the longitudinal direction of the frame according to a trajectory corresponding to the set curved side profile.

13. The curved manual treadmill according to claim 12, wherein the first portion of each wall of said plurality of walls extending starting from the inner surface of the exercise belt is configured to respectively abut against the second plurality of rotatable members of the plurality of support elements coupled to the frame.

14. The curved manual treadmill according to claim 13, wherein the first portion of the first wall of said plurality of walls extending starting from the inner surface of the exercise belt comprises a first motion transmission flexible member configured to abut against a first portion of the second plurality of rotatable members, the first motion transmission flexible member being for transmitting the rotation from the first rotational shaft to the second rotational shaft.

15. The curved manual treadmill according to claim 14, wherein the first portion of the second wall of said plurality of walls extending starting from the inner surface of the exercise belt further comprises a second motion transmission flexible member configured to abut against a second portion of the second plurality of rotatable members, the second motion transmission flexible member being for transmitting the rotation from the first rotational shaft to the second rotational shaft.

16. The curved manual treadmill according to claim 15, wherein the exercise belt comprises a plurality of slats placed side by side, each having a longitudinal extension direction that is transverse with respect to the longitudinal direction of the frame.

17. The curved manual treadmill according to claim 16, wherein each slat of said plurality of slats comprises a first end and a second end, opposite to said first end, the first end of each slat being secured to the first motion transmission flexible member operatively coupled to the first rotational shaft and the second rotational shaft so as to define the endless closed exercise track of the exercise belt, the second end of each slat being secured to the second motion transmission flexible member operatively coupled to the first rotational shaft and the second rotational shaft so as to define the endless closed exercise track of the exercise belt.

18. The curved manual treadmill according to claim 16, wherein the first and second walls of said plurality of walls are coupled to a corresponding slat of said plurality of slats.

19. The curved manual treadmill according to claim 3, further comprising a braking device operatively coupled to the first rotational shaft, the braking device comprising at least one metal disc configured to rotate about a corresponding rotational axis that is parallel to the first rotational axis of the first rotational shaft, said braking device further comprising an actuation bracket comprising at least one magnet, the actuation bracket being configured to exert on the at least one metal disc a braking action due to a magnetic effect following the interaction of said at least one magnet with the at least one metal disc.

20. The curved manual treadmill according to claim 3, wherein a first of the plurality of constraint elements comprises a first guide member secured to the frame, the first guide member comprising a first abutment surface for the first plurality of rotatable members of the plurality of sliding elements, the first abutment surface having a configuration so as to maintain the set curved side profile of the upper portion of the endless closed exercise track formed by the exercise belt substantially equal in length to the curved side profile of the curved manual treadmill.

21. The curved manual treadmill according to claim 20, comprising a plurality of support elements of the exercise belt comprising a second plurality of rotatable members, each of the second plurality of rotatable members being coupled to the frame so as to be freely rotatable about a corresponding rotational axis transverse to the longitudinal direction of the frame, wherein the second plurality of rotatable members are distributed along the longitudinal direction of the frame according to a trajectory corresponding to the set curved side profile.

22. The curved manual treadmill according to claim 3, wherein the exercise belt comprises a plurality of slats placed side by side, each having a longitudinal extension direction that is transverse with respect to the longitudinal direction of the frame.

23. The curved manual treadmill according to claim 22, wherein the first and second walls of said plurality of walls are coupled to a corresponding slat of said plurality of slats.

24. The curved manual treadmill according to claim 2, further comprising a braking device operatively coupled to the first rotational shaft, the braking device comprising at least one metal disc configured to rotate about a corresponding rotational axis that is parallel to the first rotational axis of the first rotational shaft, said braking device further comprising an actuation bracket comprising at least one magnet, the actuation bracket being configured to exert on the at least one metal disc a braking action due to a magnetic effect following the interaction of said at least one magnet with the at least one metal disc.

25. The curved manual treadmill according to claim 1, further comprising a braking device operatively coupled to the first rotational shaft, the braking device comprising at least one metal disc configured to rotate about a corresponding rotational axis that is parallel to the first rotational axis of the first rotational shaft, said braking device further comprising an actuation bracket comprising at least one magnet, the actuation bracket being configured to exert on the at least one metal disc a braking action due to a magnetic effect following the interaction of said at least one magnet with the at least one metal disc.

* * * * *